US008871286B2

(12) United States Patent
Fritz

(10) Patent No.: US 8,871,286 B2
(45) Date of Patent: Oct. 28, 2014

(54) SYNTHETIC BOARD STOCK SUITABLE FOR DIRECT FOOD CONTACT

(76) Inventor: Thomas Marshall Fritz, Newburg, PA (US)

( * ) Notice: Subject to any disclaimer, the term of this patent is extended or adjusted under 35 U.S.C. 154(b) by 0 days.

(21) Appl. No.: 13/448,326

(22) Filed: Apr. 16, 2012

(65) Prior Publication Data

US 2012/0261294 A1 Oct. 18, 2012

Related U.S. Application Data

(60) Provisional application No. 61/475,879, filed on Apr. 15, 2011.

(51) Int. Cl.

| | |
|---|---|
| ***B65D 75/38*** | (2006.01) |
| ***B65D 77/04*** | (2006.01) |
| ***B65D 81/20*** | (2006.01) |

(52) U.S. Cl.

CPC ..... *B65D 77/04* (2013.01); *B65D 81/203* (2013.01)

USPC ..... 426/129; 426/121; 426/396; 206/459.5; 206/476; 53/462

(58) Field of Classification Search

USPC ..... 426/121, 129, 396; 206/476; 53/462

See application file for complete search history.

(56) References Cited

U.S. PATENT DOCUMENTS

| | | | | |
|---|---|---|---|---|
| 3,803,332 | A * | 4/1974 | Seiferth et al. | 426/121 |
| 3,978,260 | A * | 8/1976 | Dobbins et al. | 428/204 |
| 4,552,789 | A * | 11/1985 | Winchell | 428/132 |
| 4,894,248 | A * | 1/1990 | Pappas et al. | 426/121 |
| 5,087,498 | A * | 2/1992 | Nedblake et al. | 428/76 |
| 6,074,678 | A * | 6/2000 | Blackwelder et al. | 426/129 |
| 2011/0195165 | A1* | 8/2011 | Cahill | 426/415 |

* cited by examiner

*Primary Examiner* — Rena L Dye
*Assistant Examiner* — Chaim Smith

(57) ABSTRACT

A synthetic bacon board does not wick and may be printed on both the inside of the package, with direct food contact, and on the outside of the package. The synthetic bacon board is lighter than conventional bacon boards, reducing freight costs, and is recyclable (#5 recyclable polypropylene, for example). Since it does not wick, the synthetic bacon board may be more appealing to the consumer. Moreover, consumer messages, such as coupons with optional varying background colors, may be printed on the inside of the packaging.

8 Claims, 2 Drawing Sheets

SYNTHETIC BOARD STOCK SUITABLE FOR DIRECT FOOD CONTACT

CROSS-REFERENCE TO RELATED APPLICATIONS

This application claims the benefit of priority of U.S. provisional patent application Ser. No. 61/475,879, filed Apr. 15, 2011, the contents of which are herein incorporated by reference.

BACKGROUND OF THE INVENTION

The present invention relates to food packaging and, more particularly, to synthetic board stock suitable for direct food contact printed on one or two sides, useful for packing bacon.

Conventional bacon boards use an uncoated paper board that is about nine-thousandths thick and impregnated on both sides with wax and extruded on the inside black or yellow and white on the print side. Die cut-outs and folds are used in the bacon packaging industry with this paper board. However, with conventional bacon boards, the folds and cut-outs are leech points where the liquid smoke in the bacon and/or bacon fats can wick into the paperboard, leaving wet marks on the board.

Moreover, conventional bacon boards are not recyclable and usually have a pre-printed shelf life of about 90 days.

As can be seen, there is a need for an improved bacon board that may be printed on one or both sides and does not allow wicking of liquids into the board.

SUMMARY OF THE INVENTION

In one aspect of the present invention, a bacon board for packaging bacon comprises a synthetic board stock having an inside surface and an outside surface; a perforation creating a flap to be folded over bacon resting on the synthetic board stock; and one or more window cutouts formed in the synthetic board stock.

In another aspect of the present invention, a bacon board comprises a synthetic board stock having an inside surface and an outside surface; a perforation creating a flap to be folded over bacon resting on the synthetic board stock; one or more window cutouts formed in the synthetic board stock; and printing on the inside surface of the bacon board, wherein the synthetic board stock is a #5 recyclable material that prevents wicking into the synthetic board stock.

In a further aspect of the present invention, a method for packaging bacon comprises forming synthetic bacon board, the bacon board formed from a synthetic board stock with an inside surface and an outside surface; disposing printing on an inside of the bacon board; disposing bacon on the inside of the bacon board; folding a flap along a perforation over a portion of the bacon; and wrapping the bacon and the bacon board in a wrap material.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a synthetic bacon board that does not wick and may be printed on both the inside of the package, with direct food contact, and on the outside of the package. The synthetic bacon board is lighter than conventional bacon boards, reducing freight costs, and is recyclable (#5 recyclable polypropylene, for example). Since it does not wick, the synthetic bacon board may be more appealing to the consumer. Moreover, consumer messages, such as coupons with optional varying background colors, may be printed on the inside of the packaging.

Figure 1:
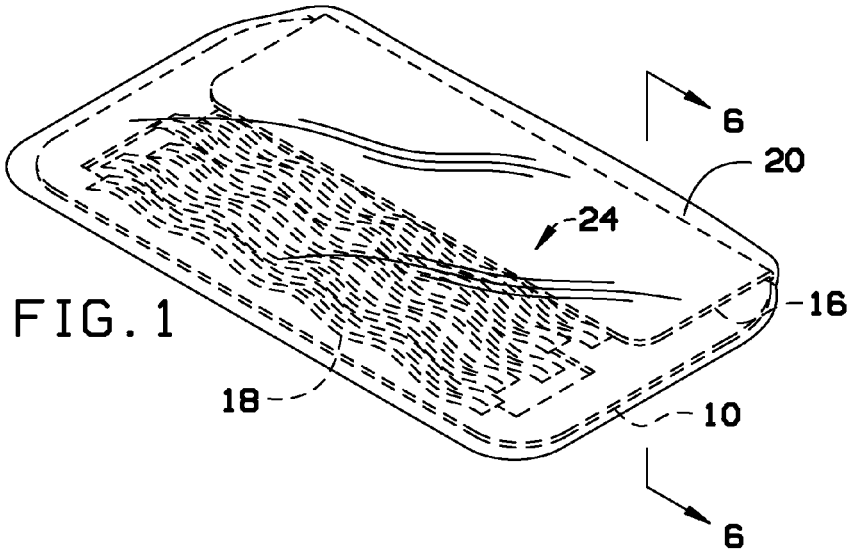
FIG. 1 is a top perspective view of bacon packaging having a bacon board according to an exemplary embodiment of the present invention.
Figure 2:
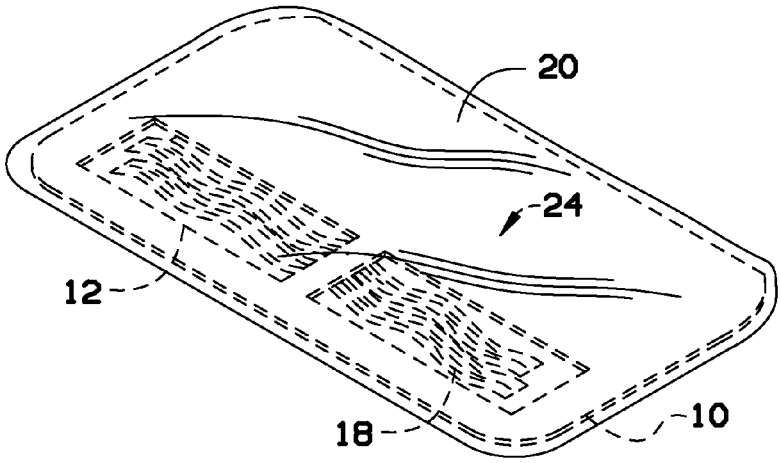
FIG. 2 is a bottom perspective view of the bacon packaging of FIG. 1.
Figure 3:
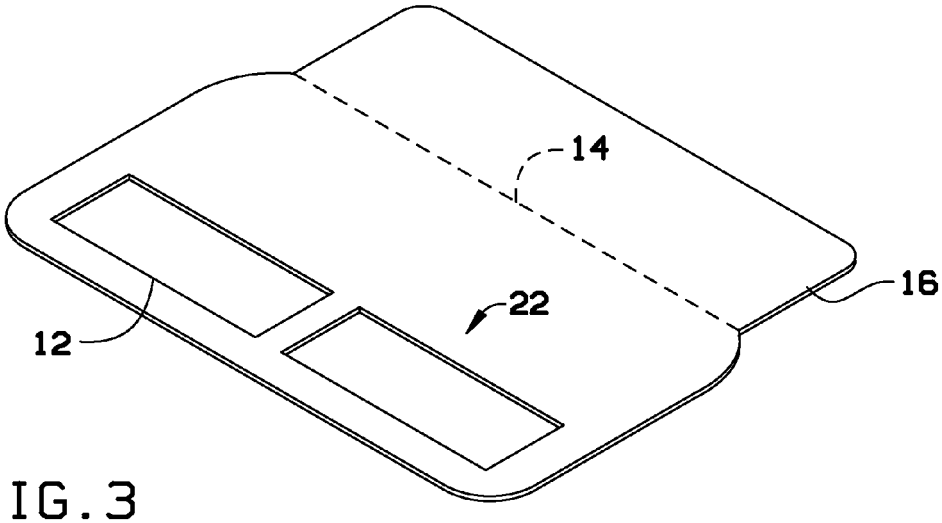
FIG. 3 is a perspective view of the bacon board used in the bacon packaging of FIG. 1.
Figure 4:
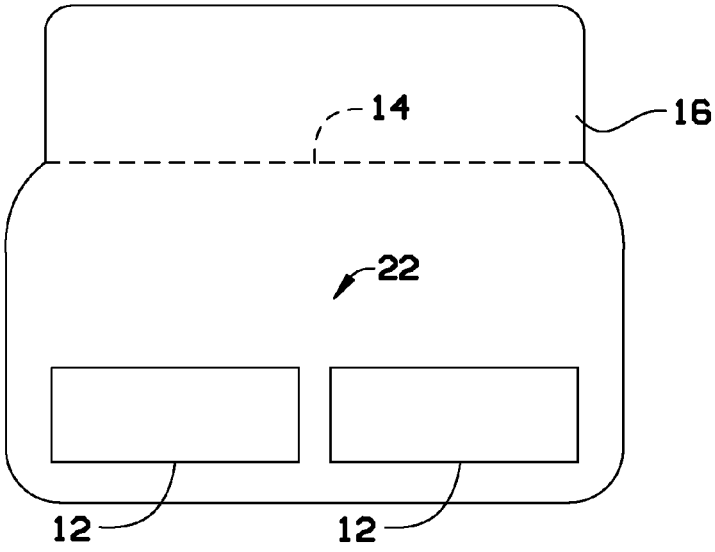
FIG. 4 is a top view of the bacon board of FIG. 3.
Figure 5:
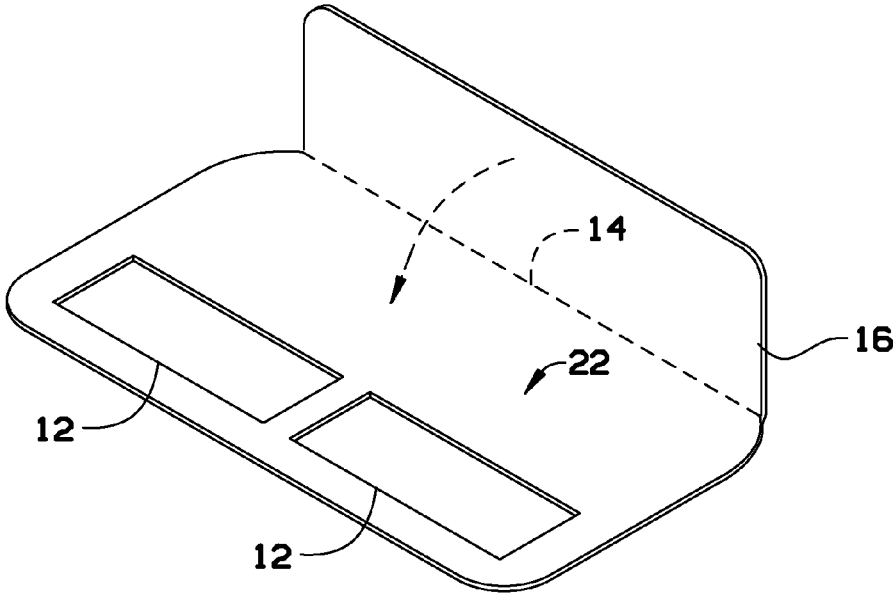
FIG. 5 is a perspective view of the bacon board of FIG. 3 showing folding of the bacon board along a perforation.
Figure 6:
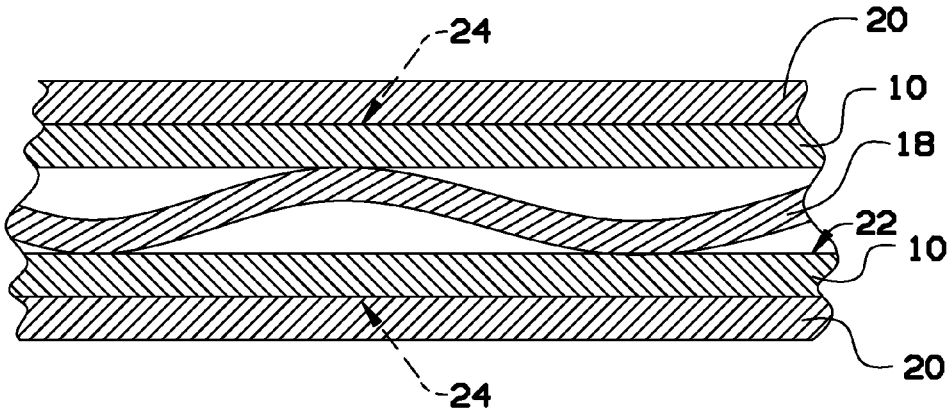
FIG. 6 is a cross sectional view taken along line 6-6 of FIG. 1.

Referring now to FIGS. 1 through 6, a synthetic bacon board 10 may be used inside a vacuum seal wrap 20 to package bacon 18. The bacon board 10 may include one or more bacon viewing window cutouts 12 permitting a user to see a back side of bacon 18 inside the wrap 20. The bacon board 10 may also include a perforation 14, creating a flap 16 that may partially cover the bacon 18. The perforation 14 may be created by various processes. The perforation 14 may not necessarily require physical perforations, provided that the perforation 14 permits the flap 16 to be folded over bacon resting bacon board 10.

An inside surface 22 of the bacon board 10 may be adapted to accept non-toxic, FDA approved colorant/ink thereupon. This surface 22 may be printed with consumer information, coupons, advertising, or the like. An outside surface 24 of the bacon board 10 may provide conventional print surface for printing, for example, product information.

The synthetic bacon board 10 may be a #5 recyclable 7.5 to 10 mil thickness, clay coated or carona treated product. The printing may be done with, for example, lithograph, flex-o, digital, silk-screened, or gravure printing processes. The synthetic bacon board 10 may be formed as a white-colored board, on both sides, allowing various colored graphics and/or inks to be used. Typically, non-toxic, FDA-approved colorant inks may be used on the direct food contact side (inside surface 22) printing.

With the synthetic bacon board 10, during manufacturing, a steel rule die may be used to cut the window cutouts 12. The material of the present invention may be "softer" than conventional bacon boards, extending the life of the steel rule die.

As described above, the synthetic bacon board 10 may be lighter than conventional bacon boards. For example, about 120,000 finished pieces of the bacon board 10 of the present invention may be shipped at the same cost of about 80,000 finished conventional bacon boards.

The bacon boards 10 of the present invention may be manufactured by various methods. For example, sheets that are about 23 inches by about 35 inches may be used and printed on each side. In some embodiments, a roll stock may be used, such as a 13 inch wide roll stock that can be printed on both sides. The window cutouts 12 may be recycled in the process.

While the above description focuses on a bacon board application, the product of the present invention may be useful in food packaging for other products, especially where anti-wicking, printability, and recyclability are desired.

It should be understood, of course, that the foregoing relates to exemplary embodiments of the invention and that modifications may be made without departing from the spirit and scope of the invention as set forth in the following claims.

What is claimed is:

1. A bacon board to package bacon comprising bacon; and a synthetic board stock having only a single layer, the single layer comprising an inside surface and an outside surface, the inside surface being a food contact surface;

a perforation in the single layer, the perforation creating a flap, the flap folded over the bacon resting on the synthetic board stock, such that the food contact surface contacts the bacon at two different sides of the bacon;

one or more window cutouts formed in the synthetic board stock;

wherein the inside of the single layer surface further comprises ink approved for direct food contact.

2. The bacon board of claim 1, wherein the synthetic board stock is a recyclable polypropylene material that does not wick.

3. The bacon board of claim 1, wherein the one or more window cutouts includes at least two window cutouts.

4. The bacon board of claim 1 wherein the outside surface of the single layer comprises printed indicia.

5. A bacon board comprising bacon; and a synthetic board stock having only a single layer, the single layer comprising an inside surface and an outside surface;

a perforation creating a flap, the flap folded over the bacon resting on the synthetic board stock;

one or more window cutouts formed in the synthetic board stock, and printing on the inside surface of the single layer, the printing being formed by a food colorant ink approved for direct food contact, wherein the synthetic board stock is a recyclable polypropylene material that does not wick.

6. The bacon board of claim 5, further comprising printing on the outside surface of the single layer.

7. A method for packaging bacon, the method comprising:

forming a synthetic bacon board, the synthetic bacon board comprising a synthetic board stock with only a single layer, the single layer comprising an inside surface and an outside surface;

disposing printing on the inside surface and the outside surface of the single layer;

disposing bacon on the inside surface of the single layer;

folding a flap formed by a perforation in the single layer over a portion of the bacon; and wrapping the bacon and the synthetic bacon board in a wrap material.

8. The method of claim 7, further comprising displaying a portion of one side of the bacon through one or more window cutouts formed through the synthetic board stock.

* * * * *